US005823843A

United States Patent [19]

Pohlman

[11] Patent Number: 5,823,843

[45] Date of Patent: Oct. 20, 1998

[54] SPHERICAL ELEMENT COMBINATION FOR CONSTRUCTION TOY SET

[76] Inventor: Joe K. Pohlman, 8344 Regis Way, Los Angeles, Calif. 90045

[21] Appl. No.: 796,774

[22] Filed: Feb. 6, 1997

[51] Int. Cl.[6] ..... A63H 33/06

[52] U.S. Cl. ..... 446/120; 446/108; 446/126

[58] Field of Search ..... 446/107, 108, 446/109, 111, 112, 115, 116, 120, 122, 125, 126, 127; 473/612

[56] References Cited

U.S. PATENT DOCUMENTS

| | | | |
|---|---|---|---|
| 2,791,868 | 5/1957 | Viken | 446/107 |
| 2,958,918 | 11/1960 | MacMillan . | |
| 3,046,016 | 7/1962 | Laws | 473/612 |
| 3,220,152 | 11/1965 | Sturm . | |
| 3,600,825 | 8/1971 | Pearce | 446/126 |
| 3,611,621 | 10/1971 | Folson . | |
| 3,780,469 | 12/1973 | Hancovsky . | |
| 3,830,011 | 8/1974 | Ochrymowich | 446/126 |
| 4,050,184 | 9/1977 | Chiari . | |
| 4,055,019 | 10/1977 | Harvey . | |
| 4,209,934 | 7/1980 | Ogawa . | |
| 4,551,111 | 11/1985 | Sherman, Jr. | 446/120 |
| 4,701,131 | 10/1987 | Hildebrandt et al. | 446/126 |
| 4,764,143 | 8/1988 | Gat et al. | 446/127 |
| 4,787,191 | 11/1988 | Shima | 446/126 |
| 4,901,672 | 2/1990 | Rosenberger | 446/122 |
| 5,282,767 | 2/1994 | Gelardi | 446/126 |

FOREIGN PATENT DOCUMENTS

| | | | |
|---|---|---|---|
| 740659 | 7/1944 | Germany | 446/126 |
| 2617098 | 3/1977 | Germany | 446/111 |
| 3635947 | 2/1988 | Germany | 446/107 |
| 366230 | 1/1963 | Switzerland | 446/126 |

*Primary Examiner*—Robert A. Hafer
*Assistant Examiner*—Jeffrey D. Carlson

[57] ABSTRACT

A plurality of arcuate beam elements each having ends defining coupling mechanisms is assembled in an interlocking framework using a plurality of multiply couplable couplers to form arcuate segments which define a sphere or portion of a sphere. A plurality of spherical inserts each defining a one-eighth spherical segment is assembled to the spherical framework to complete a sphere or spherical segment using a snap-fit attachment.

10 Claims, 2 Drawing Sheets

SPHERICAL ELEMENT COMBINATION FOR CONSTRUCTION TOY SET

CROSS-REFERENCE TO RELATED PATENT APPLICATIONS

This application discloses apparatus described in copending application Ser. No. 08/796,252 (pending) and filed Feb. 6, 1997 and entitled CONSTRUCTION TOY SET FOR ASSEMBLING A STEERABLE TOY VEHICLE in the name of the applicant of the present application which is assigned to the assignee of the present application.

FIELD OF THE INVENTION

This invention relates generally to construction toy sets and particularly to those utilizing specialty elements having spherical portions.

BACKGROUND OF THE INVENTION

Construction toy playsets have been provided in different forms for many decades. Earliest construction toy sets provided a plurality of elongated metal elements together with suitable fastening devices to form various apparatus and play structures. Other early construction toy playsets utilize various elongated elements having end pegs together with coupling elements formed of wood or similar material having plural peg receiving passages allowing the pegged elements to be assembled to form various structures and toy apparatus. Construction toy playsets provide substantial developmental activity for the child user and thus are very well received and appreciated by educators and parents. The challenge for providing construction toy sets which enjoy commercial success is the dual roll of entertainment and amusement on one hand and child developmental skills on the other. In order for the child user to maximize the developmental activity, the user must remain interested in and challenged by the toy playset. The amusement and entertainment aspects of the toy playset provide the primary motivation for use which leads to the desired developmental skills.

Recognizing the enormous success of construction toy sets, practitioners in the art have, through the years, provided a virtually endless variety of such construction sets. Modern construction toy sets utilize large numbers of molded plastic parts which form cooperating interlock or snap-fit attachments to provide maximum flexibility and challenge for the user. As a result, construction toy sets are provided which facilitate assembling a great variety of items ranging from structural dwellings to toy vehicles or the like. In many instances, practitioners provide various specialty items within the plurality of generic construction elements to facilitate the assembly of challenging devices or apparatus.

U.S. Pat. No. 3,234,683 issued to Christiansen sets forth a TOY BUILDING ELEMENT INCLUDING A ROTATABLE BUSHING having plural interlocking building elements which accommodate a rotatable bushing and shaft combination. As a result, structures such as rotatable wheels may provided.

U.S. Pat. No. 5,069,647 issued to Zuviria sets forth a SOLID RECTANGULAR BUILDING BLOCK FOR TOY BUILDING SET having a plurality of block structures defining plural ribs and grooves allowing the blocks to interlock. Additional elements may be secured to the blocks such as wheel shafts or the like to enhance flexibility.

U.S. Pat. No. 5,310,376 issued to Mayuzumi, et al. sets forth a TOY THAT CAN BE ASSEMBLED INDEPENDENTLY BY A CHILD having a planar base member defining a plurality of peg receiving holes therein together with a plurality of coupling elements supporting plural outwardly extending pegs. Elongated flexible elements are interlockably received upon the coupling elements allowing various structures to be fabricated.

U.S. Pat. No. 3,604,130 issued to Forsstrom sets forth a CONSTRUCTION SERIES FOR MOLECULAR MODELS having a plurality of generally spherical interlocking elements which may be assembled to represent various atoms and molecules.

U.S. Pat. No. 4,109,398 issued to Hida sets forth an CONSTRUCTION TYPE EDUCATIONAL AND AMUSEMENT DEVICE having a basic element which defines a generally spherical hollow module or capsule having adjuncts which may be interconnected and operatively assembled into a large number of different configurations to form various apparatus.

U.S. Pat. No. 4,509,929 issued to Zawitz sets forth an ANNULAR SUPPORT DEVICE WITH PIVOTAL SEGMENTS having a plurality of torus segments interconnectable end to end to form an annular loop in which each segment is independently pivotal to form various shapes.

U.S. Pat. No. 4,631,040 issued to Shiraishi sets forth a CONSTRUCTION TOY SET having a variety of component parts including bases, housings and auxiliary members. Male and female connecting elements attached to the respective components allow for assembly in a variety of configurations.

U.S. Pat. No. 4,764,143 issued to Gat, et al. sets forth ASSEMBLY TOYS FOR JOINING CYLINDRICAL OBJECTS having a plurality of devices for removably connecting a plurality of cylindrical objects. Each device includes apparatus for interconnecting to other devices at a variety of angles and for securing a cylindrical object.

U.S. Pat. No. 5,046,982 issued to Erickson sets forth CONSTRUCTION APPARATUS having a plurality of relatively flat components each having at least three sides. The apparatus further includes an elongated rod-like member extending along each side and in large corner portions between the members. A plurality of connectors are provided for interconnecting adjacent sides of members to form structures.

In many construction sets, apparatus is provided for specialized assembly such as toy vehicles or the like. For example, U.S. Pat. No. 4,802,876 issued to Bertrand sets forth an AXLE STRUCTURE AND AXLE JOINT FOR CONSTRUCTION TOY ASSEMBLY having a base plate, an abutment plate normal to one edge of the base plate, a cross-shaped columnar connector perpendicular to the base plate and a cross-shaped shaft perpendicular to the abutment shape. The shaft defines bulges at its free end and is attachable to the cross-shaped structure.

U.S. Pat. No. 5,071,384 issued to Poulsen sets forth a STEERING MECHANISM for use with toy building sets to assemble devices such as toy vehicles. The mechanism includes rack means and a pinion cooperating therewith.

U.S. Pat. No. 4,690,656 issued to Friedman, et al. sets forth WHEEL AND WINCH ASSEMBLIES utilizing identical hubs and axles in a toy construction set. A special block having a axle projecting therefrom is provided and a hub mechanism is receivable upon the shaft to support a resilient tire.

U.S. Pat. No. 4,599,077 issued to Vuillard sets forth a MODULAR TOY while U.S. Pat. Nos. 4,202,132 and 4,136,482 both issued to Fischer set forth interacting structural elements generally related to construction toy sets.

U.S. Pat. No. 2,958,918 issued to MacMillan sets forth a MOLD AND METHOD FOR MAKING A DOME STRUCTURE having a spherical framework for forming a plurality of spherical sections having interlocking tabs and notches for forming a dome dwelling.

U.S. Pat. No. 3,220,152 issued to Strum sets forth a TRUSS STRUCTURE having a plurality of interconnected straight line elements and connecting nodes for forming a domed structural roof or the like.

U.S. Pat. No. 3,611,621 issued to Folson sets forth a BUILDING UNIT TOY having a pair of hemispherical building elements interlockably formable into a sphere together with a plurality of interlocking rectangular components mountable to the sphere.

U.S. Pat. No. 3,780,469 issued to Hancovsky sets forth a SECTIONAL CREATIVE TOY having a plurality of interlocking arcuate members forming a plurality of differently shaped figures.

U.S. Pat. No. 4,050,184 issued to Chiari sets forth a MULTICOMPONENT SPHERICAL ASSEMBLABLE TOY having an inner supporting structure consisting of a plurality of quadrilateral elements connected by H-shaped couplers and a plurality of convex quadrilateral cover plates.

U.S. Pat. No. 4,055,019 issued to Harvey sets forth a CONSTRUCTIONAL TOY AND ELEMENT THEREFOR having a substantially planar element for use in building up of a model structure by hingedly and detachably connecting a plurality of such elements in an edge to edge relationship.

U.S. Pat. No. 4,209,934 issued to Ogawa sets forth MODULAR TOY BUILDING UNITS having a plurality of polygonal substantially plate-like panel members and a plurality of connecting members for forming various structures.

U.S. Pat. No. 4,551,111 issued to Sherman, Jr. sets forth a BALL-LIKE CONSTRUCTION FOR A TOY OR THE LIKE having a plurality of hollow wedges mountable to a central disk to form a unitary assembly.

SUMMARY OF THE INVENTION

Accordingly, it is a general object of the present invention to provide an improved construction toy set. It is a more particular object of the present invention to provide an improved construction toy set having a spherical element combination fabricated of a plurality of interlocking construction toy set elements. It is a still further object of the present invention to provide a spherical element combination for construction toy set which is usable in combination with a plurality of interlocking snap-fit attachable construction toy elements.

In accordance with the present invention, there is provided a spherical element combination construction toy comprising: a plurality of arcuate beam elements each defining an arcuate body having ends defining a first snap-fit connector structure; a plurality of couplers each defining a plurality of second snap-fit connector structures, the second snap-fit connector structures cooperating with the first snap-fit connector structures to interlockably connect the plurality of arcuate beam elements to form a framework for a sphere or spherical portion; a plurality of spherical inserts each defining a segment of a sphere; and means for snap-fit attaching the spherical inserts to the framework to complete a sphere or spherical portion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
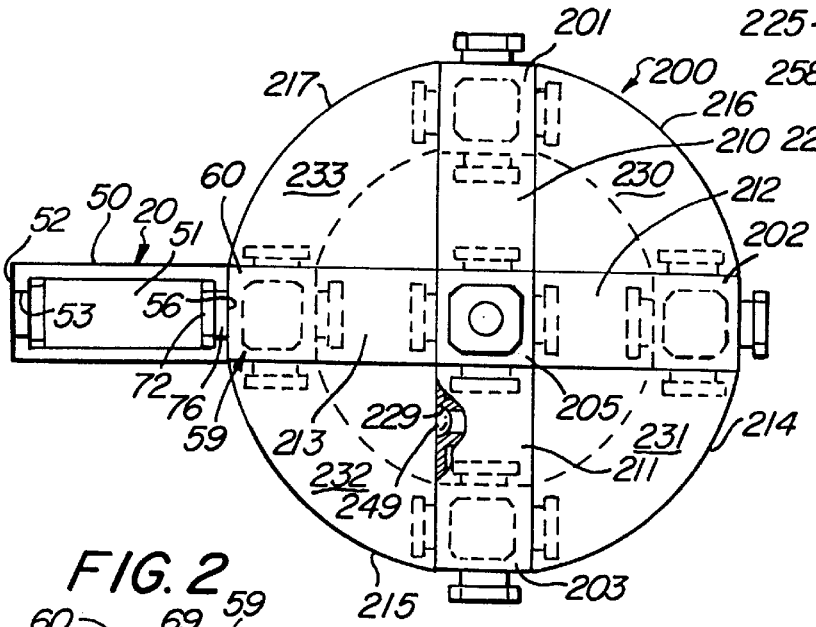
FIG. 1 sets forth a side elevation view of a spherical element combination for construction toy set constructed in accordance with the present invention.

FIG. 1 sets forth a side elevation view of a spherical element combination constructed in accordance with the present invention and generally referenced by numeral 200. In accordance with the present invention, spherical element combination 200 is formed of an interlocking plurality of construction toy elements. These interlocking construction toy elements include a plurality of couplers such as coupler 59 shown in FIG. 2, a plurality of spherical inserts such as spherical insert 230 shown in FIG. 9, and a plurality of arcuate beam elements such as arcuate beam element 221 seen in FIG. 10. In addition, other construction toy elements such as beam element 20 shown in FIG. 1 are combinable with the spherical combination to form still further construction toy apparatus. It will be apparent to those skilled in the art from the descriptions which follow that a plurality of spherical element combinations may be fabricated utilizing different numbers and combinations of these three basic construction toy elements. For example, FIG. 1 shows a spherical element combination 200 which forms a complete sphere while FIG. 11 sets forth a perspective assembly view of a spherical element combination 280 which forms a hemispherical structure. It will be apparent to those skilled in the art that different spherical element combinations may be fabricated using the present invention construction toy set to provide additional variations such as one-eighth of a sphere or other multiples of one-eighth.

With specific reference to FIG. 1, spherical element combination 200 includes a plurality of couplers 201 through 206 together with a coupler 59. A plurality of arcuate beam elements 210 through 221 (elements 218, 219 and 220 seen in FIG. 11) are interlockably secured to couplers 201 through 206 and coupler 59 to form three mutually perpendicular intersecting circular combinations which define the boundaries of the sphere formed as spherical element combination 200. As is better seen in FIG. 10, each arcuate beam element includes an appropriately formed slot for receiving cooperating flanges of each coupler in the snap-fit assembly described above.

Figure 9:
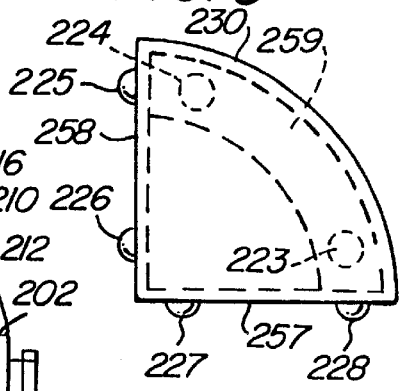
FIG. 9 sets forth a side elevation view of a typical spherical insert utilized in the present invention spherical element combination.

Once arcuate beam elements 210 through 221 and couplers 201 through 206 and 59 are interlockably assembled to form the spherical framework of three mutually perpendicular intersecting circular combinations, spherical element combination 200 is completed by adding eight spherical inserts each constructed in the manner shown by spherical insert 230 in FIG. 9. With temporary reference to FIGS. 9, 10 and 11, it will be noted that each spherical insert of the eight spherical inserts required to complete spherical element combination 200 provides a one-eighth spherical member having three curved sides each of which supports a pair of extensions. In addition, each arcuate beam element defines a plurality of concave recesses which receive the projections of the spherical insert to provide a snap-fit attachment captivating each spherical insert between three adjoining arcuate beam elements.

Returning to FIG. 1, the snap-fit attachment of the spherical inserts within the framework provided by arcuate beam elements and couplers is illustrated for spherical insert 230 which defines a projection 249 extending into a recess 229 formed in adjoining arcuate beam element 211. It will be understood that each spherical element within spherical element combination 200 is maintained using this snap-fit attachment.

Figure 2:
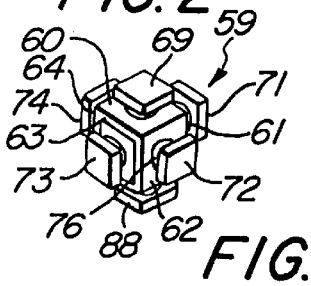
FIG. 2 sets forth a perspective view of a typical six-sided coupler utilized in the present invention construction toy set.

FIG. 2 sets forth a perspective view of coupler 59 which will be understood to be representative of the couplers utilized in forming spherical element combination 200 and variations thereof. Coupler 59 includes a cubic body 60 defining six sides each supporting an outwardly extending cylindrical boss and substantially square coupling flange. For example, boss 76 extends outwardly from side 62 and supports coupling flange 72. Coupler 59 describes similar structures for facet 61 which supports flange 71, facet 63 which supports flange 73, and facet 64 which supports 74. Further, an upwardly facing flange 69 and a downwardly facing flange 88 are similarly formed on cubic body 60.

Figure 3:
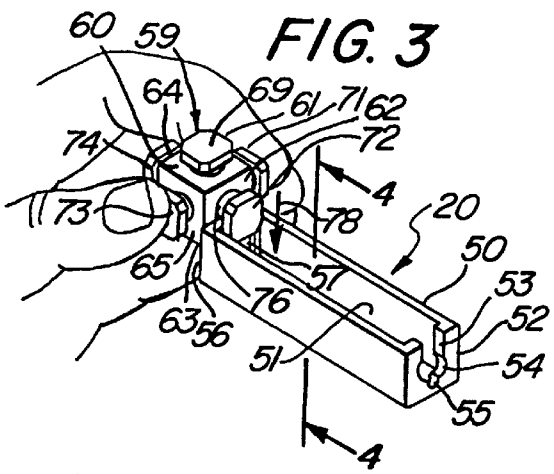
FIG. 3 sets forth a perspective assembly view of a standard coupler and standard beam element during attachment.

FIG. 3 sets forth a perspective assembly view showing the interlocking attachment of a typical coupler 59 to a typical beam element 20. As described above, beam element 20 defines an elongated generally rectangular body 50 having opposed ends 52 and 56. Beam element 20 is essentially three-sided having three mutually perpendicular generally planar sides extending between ends 52 and 56 and an open side and interior channel 51. Ends 52 and 56 are identical and define the basic attachment feature which cooperates with coupler 59 in a snap-fit assembly. Thus, end 52 defines a slot 53 and a circular notch 54. Beneath notch 54, a relief notch 55 is also formed. As is better seen in FIG. 6, relief notch 55 facilitates the separation of slot 53 and notch 54 during the removal and attachment of an element such as coupler 59. Correspondingly, end 56 which is identical to end 52 defines a slot 57, a circular notch 66, and a relief notch 67 (better seen in FIG. 4).

Coupler 59 is a typical coupler such as coupler 31 shown above in FIG. 1 and defines a generally cubic body 60 having four planar sides or facets 61 through 64. In addition, cubic body 60 defines open sides on the top and bottom within the interior of which a cylindrical boss 69 is formed. Facets 61 through 64 support outwardly extending cylindrical bosses such as boss 76 extending from facet 62. A corresponding plurality of generally rectangular flanges 71 through 74 are supported in a spaced relationship from facets 61 through 64 respectively. The spacing of flanges 71 through 74 from their respective supporting faces 61 through 64 of coupler 59 facilitates the insertion of coupler 59 into a snap-fit attachment with a cooperating element such as beam element 20.

Figure 7:
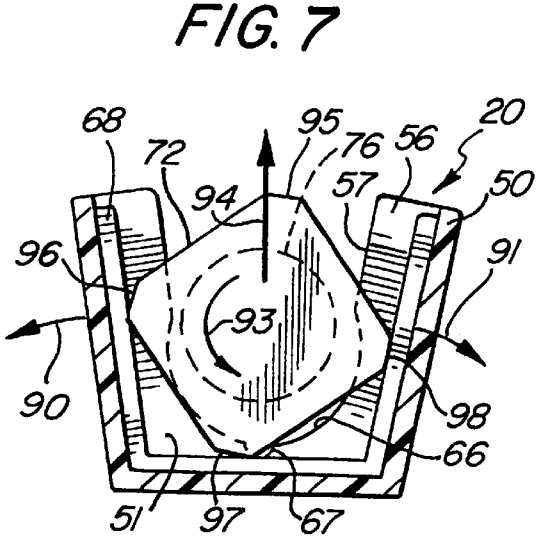
FIG. 7 sets forth a section view of the combination of FIG. 6 taken along section lines 7—7 therein.
Figure 4:
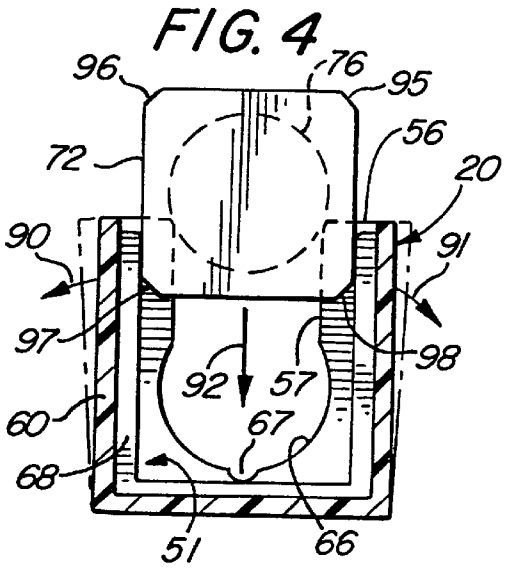
FIG. 4 sets forth a section view of the beam element and coupler combination of FIG. 3 taken along section lines 4—4 therein.
Figure 5:
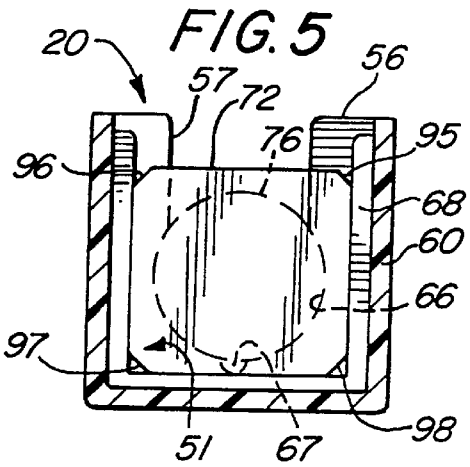
FIG. 5 sets forth a section view of the coupler and beam combination of FIG. 3 in the fully assembled position taken along section lines 4—4 therein.
Figure 6:
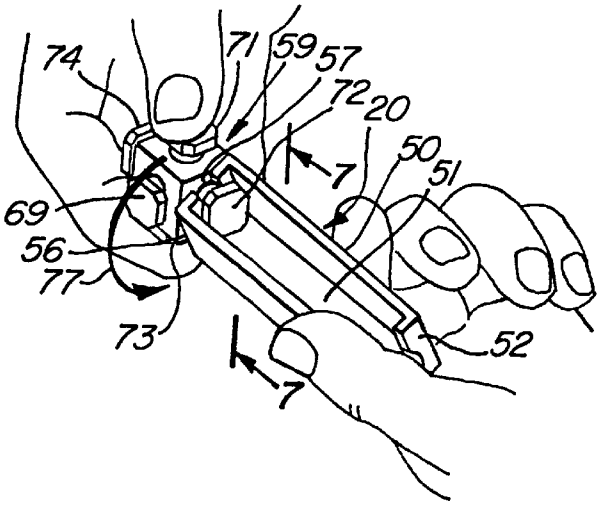
FIG. 6 sets forth a perspective view of the combination of a beam element and coupler during disassembly.

The attachment of coupler 59 to beam element 20 illustrated in FIGS. 2, 3 and 4 as well as the removal or separation of that attachment illustrated in FIGS. 6 and 7 is typical of the interconnection of elements within the present invention construction toy set. Accordingly, the descriptions which follow in combination with FIGS. 3 through 7 should be understood to apply generally to the various structural attachments and connections shown throughout the remainder of the construction toy set.

Returning to FIG. 3, coupler 59 is shown being attached to beam element 20. In this attachment, cylindrical boss 76 of coupler 59 is aligned with slot 57 of beam element 20 which causes end 56 of beam element 20 to be positioned between facet 62 and flange 72. Thereafter, the coupler is forced downwardly as indicated by arrow 78 to force cylindrical boss 76 through slot 57 to be received within circular notch 66. During this insertion process, the elastic material of beam element 20 facilitates a spreading of slot 57 to allow boss 76 to pass into notch 66. Thereafter, the resilient material of body 50 maintains a snap-fit attachment. It will be apparent to those skilled in the art that flanges 71, 73 and 74 could alternatively be secured to beam element 20 in this manner. It will be further apparent to those skilled in the art that a similar coupler to coupler 59 may be secured to end 52 of beam element 20 in a similar fashion.

FIGS. 4 and 5 set forth respective partial section views of the insertion of coupler 59 into beam element 20. In the preferred fabrication of the present invention construction toy set, the various structural elements and couplers as well as the specialty items are preferably formed of a somewhat resilient material such as molded plastic or the like. This resilience facilitates the snap-fit adjustment illustrated in FIGS. 3 through 5. With specific reference to FIG. 4, flange 72 supported by boss 76 defines a plurality of corner facets 95 through 98 which operate in the manner set forth in FIGS. 6 and 7 to facilitate removal of the coupler from an element such as beam element 20. Beam element 20 defines an end 56 having a slot 57 and a circular notch 66 together with a relief notch 67 formed therein. As described above, beam element 20 defines a three-sided open faced elongated rectangular element having an interior channel 51 extending between the respective ends thereof. Beam element 20 further defines a generally U-shaped rib 68 positioned against the interior corner of end 56 within interior channel 51 of beam element 20. Assembly is carried forward by positioning cylindrical boss 76 in alignment with slot 57 such that flange 72 extends into interior channel 51 and is received between opposed sides of rib 68. Thereafter, coupler 59 is forced into interior channel 51 in the direction indicated by arrow 92. Because the diameter of boss 76 is slightly larger than slot 57, the resilient material of beam element 20 is deformed slightly as coupler 59 is forced downwardly. This deformation takes the form of a resilient opening of the sides of beam element 20 in the directions indicated by arrows 90 and 91. As the sides of beam element 20 flex outwardly, boss 76 passes through slot 57 and is received within notch 66. The travel of boss 76 into notch 66 allows the elastic return of beam element 20 to its natural shape captivating boss 76 within notch 66. Relief notch 67 facilitates the flexing of beam element 20 during this process.

FIG. 5 sets forth the assembled or coupled position of coupler 59 to beam element 20. As can be seen, flange 72 of coupler 59 is received within the three-sided enclosure of rib 68 and is thus maintained in a non-rotational attachment. As may also be seen, cylindrical boss 76 of coupler 59 is captivated within notch 66 and held therein by the resilient character of beam element 20. At this point, the attachment or coupling of coupler 59 to beam element 20 is complete.

FIG. 6 sets forth a perspective view of the initial operation of removing coupling 59 from beam element 20. Thus, coupler 59 having flanges 71 through 74 and a center boss 69 is grasped firmly by the user in one end while the remaining hand grasps beam element 20. As described above, beam element 20 includes a body 50 preferably formed of a resilient molded plastic material defining an interior channel 51 and opposed end 56 and 52. In the initial step of disassembly, coupler 59 is rotated with respect to beam element 20 in either direction. For purposes of illustration, FIG. 6 shows coupler 59 rotated in the direction indicated by arrow 77.

FIG. 7 sets forth a section view taken along section lines 7—7 in FIG. 6 showing the initial step of coupler element removal illustrated in FIG. 6. As described above, beam element 20 defines a three-sided elongated rectangular body 50 having a U-shaped rib 68 formed therein. Beam element 20 also includes an end 56 having a slot 57 and a notch 66 formed therein. A relief notch 67 is also formed in end 56 of beam element 20. Coupler 59 includes a flange 72 supported by a cylindrical boss 76. Flange 72 further defines corner facets 95 through 98 at each corner of the square flange. As the above-described rotation of coupler 59 with respect to beam element 20 takes place, flange 72 is rotated in the direction indicated by arrow 93. As a result, facets 96 and 98 are forced against opposed sides of rib 68 while facet 97 is forced against the bottom side of rib 68. The resilient material of beam element 20 allows the sides of the beam element to flex outwardly in the directions indicated by arrows 90 and 91 which releases boss 76 from its captivation within notch 66. Thereafter, with flange 72 maintained in the rotational position shown in FIG. 7, coupler 59 may be withdrawn outwardly in the direction indicated by arrow 94 and removed from its attachment to beam element 20. Once coupler 59 is removed, the resilient material of body 50 allows beam element 20 to return to its normal shape.

Figure 8:
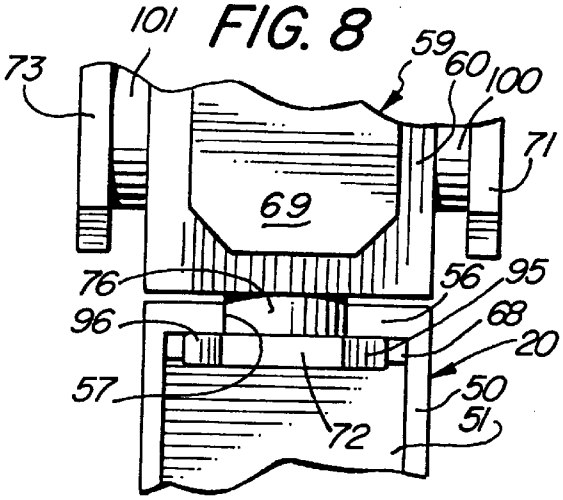
FIG. 8 sets forth a partial top view of a coupler and beam element.

FIG. 8 sets forth a partial top view of an installed attachment between coupler 59 and beam element 20. As described above, coupler 59 includes a plurality of facets each supporting a respective cylindrical boss. In FIG. 8, cylindrical bosses 100 and 101 are shown on opposed sides of body 60 supporting flanges 71 and 73 respectively. Similarly, boss 76 extends outwardly from body 60 and supports a flange 71 in a spaced relationship. Flange 72, it will be recalled, defines a plurality of corner facets such as facets 95 and 96. Beam element 20 defines an end 56 which in turn defines a slot 57. As is seen above, end 56 of beam element 20 also defines a notch 66 which receives boss 76 in the above-described attachment. Flange 72 is spaced from body 60 of coupler 59 so as to receive end 56 in the above-described attachment. Rib 68 extends inwardly into interior channel 51 of body 50 to provide nonrotational attachment of flange 72. It will be understood that the attachment between coupler 59 and beam element 20 shown in FIG. 8 is typical of the snap-fit attachments utilized in the present invention construction toy set.

FIG. 9 sets forth a side elevation view of a typical spherical insert generally referenced by numeral 230. As described above, each spherical insert within spherical element combination 200 (seen in FIG. 1) forms a one-eighth portion of a sphere and defines three intersecting curved surfaces. Thus, spherical insert 230 includes a plurality of curved surfaces 257, 258 and 259 at each edge of the spherical element. Spherical surface 257 further includes a pair of projections 227 and 228 which facilitate the above-described interlocking action for the spherical insert and its adjoining arcuate beam elements. Similarly, surface 258 defines projections 225 and 226 while surface 259 defines projections 223 and 224. In its preferred form, spherical insert 230 as well as the remaining inserts are fabricated as a molded plastic unit or the like.

Figure 10:
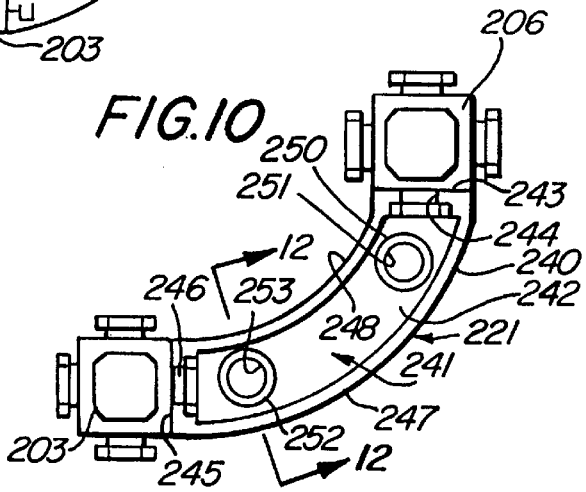
FIG. 10 sets forth a top view of a combination formed by an arcuate beam element having couplers snap-fit assembled to each end thereof.

FIG. 10 sets forth an assembled combination of an arcuate beam element and a pair of couplers secured to each end thereof. More specifically, arcuate beam element 221 includes an arcuate body 240 having curved wall 247 and an interior wall 248. An interior cavity 241 is formed between the curved walls and a pair of opposed ends 243 and 245 are formed on arcuate body 240. End 243 defines a slot 244 configured in the manner described above for beam element 20 facilitating snap-fit attachment of a coupler 206. Similarly, end 245 defines a slot 246 also configured to receive a cooperating coupler such as coupler 203. Couplers 203 and 206 are substantially identical to coupler 59 shown in FIG. 2.

Figure 12:
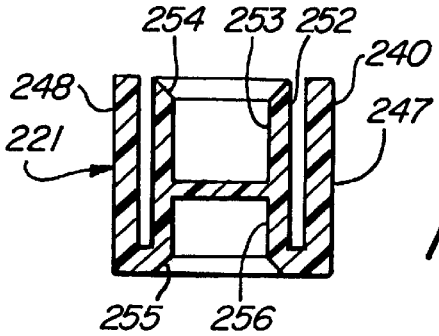
FIG. 12 sets forth a section view of the arcuate beam element of FIG. 10 taken along section lines 12—12 therein.

Arcuate body 240 further defines a pair of cylindrical bosses 250 and 252 within interior cavity 241 having respective recesses 251 and 253 formed therein. The function of bosses 250 and 252 as well as recesses 251 and 253 provides for the above-described snap-fit attachment of spherical inserts such as spherical insert 230 seen in FIG. 9. While not seen in FIG. 10, it will be understood by those skilled in the art that arcuate body 240 further defines a corresponding opposed pair of cylindrical bosses having recesses defined therein on the opposite side of arcuate body 240. For example, FIG. 12 shows a section view of arcuate body 240 including cylindrical boss 252 having opposed recesses 253 and 256.

Figure 11:
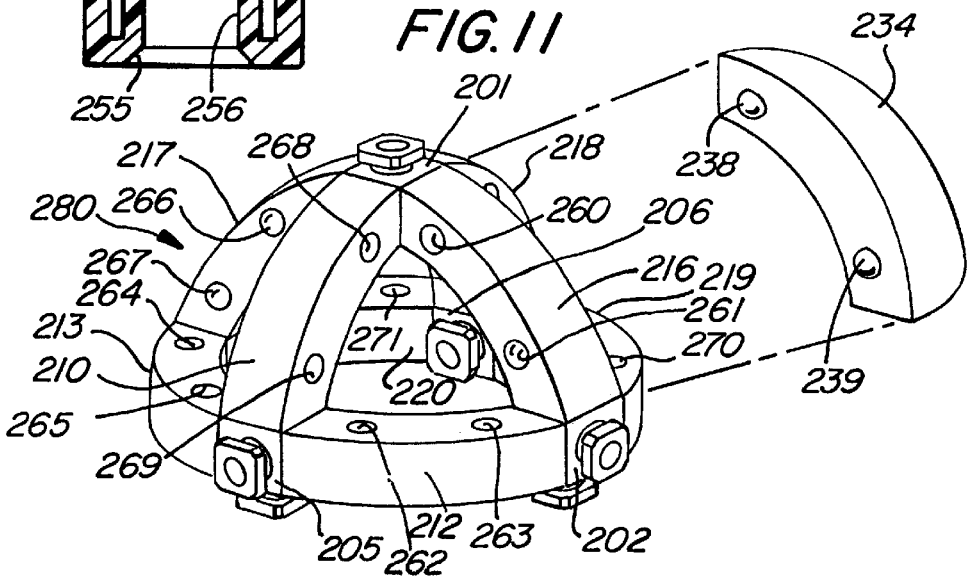
FIG. 11 sets forth a perspective assembly view of a hemispherical element combination constructed in accordance with the present invention.

FIG. 11 sets forth a perspective assembly view of a spherical element combination 280 which provides a hemispherical element combination. Comparison of FIGS. 1 and 11 will reveal that spherical element combination 280 is, in essence, one-half of spherical element combination 200. Thus, spherical element combination 280 includes a plurality of arcuate beam elements 210, 212, 213, 216, 217, 218, 219 and 220 secured to form a hemispherical frame using a plurality of couplers 201, 202, 205, 206 and 59. As described above, each arcuate beam element defines a plurality of recesses for receiving projections of spherical inserts. Thus, arcuate beam element 210 defines recesses 268 and 269, element 212 defines recesses 262 and 263, element 213 defines recesses 264 and 265, element 216 defines recesses 260 and 261, element 217 defines recesses 266 and 267, element 219 defines a recess 270 and element 220 defines a recess 271. While the perspective view of FIG. 11 does not facilitate showing each arcuate beam element in detail, it will be recalled that as described in conjunction in FIG. 10 above, each arcuate beam element defines a total of four recesses to facilitate snap-fit attachment of a spherical insert.

FIG. 11 shows a typical spherical insert 234 having a plurality of projections such as projections 238 and 239.

Spherical insert 234 forms a one-eighth portion of a sphere and is received in a selected space between three surrounding arcuate beam elements to commence final assembly of spherical element combination 280. It will be apparent that completion of a hemispherical element for spherical element combination 280 requires an additional trio of spherical inserts each fitted within a space formed by three intersecting arcuate beam elements.

FIG. 12 sets forth a section view of arcuate beam element 221 taken along section lines 12—12 in FIG. 10. The section view of FIG. 12 sets forth the structure by which arcuate beam elements such as element 221 define pairs of cylindrical bosses each having oppositely facing recesses for the above-described snap-fit attachment of spherical inserts such as spherical insert 230 shown in FIG. 9. Accordingly, arcuate beam element 221 defines curved walls 247 and 248 and a cylindrical boss 252. Boss 252 defines oppositely facing recesses 253 and 256. To further enhance the snap-fit attachment of spherical inserts described above, recess 253 defines a tapered surface 254 while recess 256 defines a tapered surface 255. Tapered surfaces 254 and 255 provide better snap-fit insertion of the projections extending from the spherical inserts such as projections 227 and 228 of spherical insert 230.

As described above, each arcuate beam element defines a pair of cylindrical boss structures identical to cylindrical boss 252 shown in FIG. 12 for arcuate beam element 221.

In addition to forming spherical element combinations comprising a complete sphere or portion thereof, the above-described construction toy combination facilitates attachment of other construction toy elements due to the provision of the various couplers which include an outwardly extending coupling flange. Thus, as is seen for example in FIG. 1, a beam element 220 is receivable upon coupler 59 to further attach spherical element combination 200 to other structural apparatus in a construction toy set. It will be apparent to those skilled in the art that other combinations of construction toy elements may be secured to the present invention spherical element combinations using the above-described snap-fit assembly.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

It is claimed:

1. A spherical element combination construction toy comprising:

a framework for a sphere or spherical portion having a plurality of arcuate beam elements each defining an arcuate body having ends defining a first snap-fit connector structure and a plurality of couplers each defining a plurality of second snap-fit connector structures, said second snap-fit connector structures cooperating with said first snap-fit connector structures to interlockably connect said plurality of arcuate beam elements to form said framework for a sphere or spherical portion;

a plurality of spherical inserts each defining an approximate one eighth segment of a sphere; and means for snap-fit attaching said spherical inserts to said framework to complete a sphere or spherical portion.

2. A spherical element combination construction toy as set forth in claim 1 wherein said framework includes eight arcuate beam elements and five couplers and forms a hemispherical frame.

3. A spherical element combination construction toy as set forth in claim 2 wherein said framework supports four spherical inserts to complete a hemisphere.

4. A spherical element combination construction toy as set forth in claim 1 wherein said framework includes twelve arcuate beam elements and six couplers and forms a spherical frame.

5. A spherical element combination construction toy as set forth in claim 4 wherein said framework supports eight spherical inserts to complete a sphere.

6. A spherical element combination construction toy comprising:

a framework for a sphere or spherical portion having a plurality of arcuate beam elements each defining an arcuate body having ends defining a first snap-fit connector structure and a plurality of couplers each defining a plurality of second snap-fit connector structures, said second snap-fit connector structures cooperating with said first snap-fit connector structures to interlockably connect said plurality of arcuate beam elements to form said framework for a sphere or spherical portion;

a plurality of spherical inserts each defining an approximate one eighth segment of a sphere; and means for snap-fit attaching said spherical inserts to said framework to complete a sphere or spherical portion including a plurality of bosses, each defining a concave recess, supported upon said arcuate beam elements and a plurality of projections extending from said spherical inserts, each of said projections being received within cooperating recesses in said bosses when one of said spherical inserts is fitted to said framework.

7. A spherical element combination construction toy as set forth in claim 6 wherein said framework includes eight arcuate beam elements and five couplers and forms a hemispherical frame.

8. A spherical element combination construction toy as set forth in claim 7 wherein said framework supports four spherical inserts to complete a hemisphere.

9. A spherical element combination construction toy as set forth in claim 6 wherein said framework includes twelve arcuate beam elements and six couplers and forms a spherical frame.

10. A spherical element combination construction toy as set forth in claim 6 wherein said framework supports eight spherical inserts to complete a sphere.

* * * * *